US010789968B2

(12) United States Patent
Huang et al.

(10) Patent No.: US 10,789,968 B2
(45) Date of Patent: Sep. 29, 2020

(54) SOUND PLAYBACK DEVICE AND NOISE REDUCING METHOD THEREOF

(71) Applicant: Unlimiter MFA Co., Ltd., Eden Island (SC)

(72) Inventors: Yu-Chieh Huang, Taipei (TW); Kuo-Ping Yang, Taipei (TW); Po-Jui Wu, Taipei (TW); Kuan-Li Chao, Taipei (TW)

(73) Assignee: UNLIMITER MFA CO., LTD, Eden Islan (SC)

( * ) Notice: Subject to any disclaimer, the term of this patent is extended or adjusted under 35 U.S.C. 154(b) by 0 days.

(21) Appl. No.: 16/548,877

(22) Filed: Aug. 23, 2019

(65) Prior Publication Data

US 2020/0111503 A1 Apr. 9, 2020

(30) Foreign Application Priority Data

Oct. 4, 2018 (TW) ..... 107135134 A

(51) Int. Cl.
*G10L 21/0232* (2013.01)
*G10L 25/51* (2013.01)

(52) U.S. Cl.
CPC ..... *G10L 21/0232* (2013.01); *G10L 25/51* (2013.01)

(58) Field of Classification Search
CPC ..... G10L 21/0232; G10L 25/51
USPC ..... 381/94.3, 94.1, 73.1
See application file for complete search history.

(56) References Cited

U.S. PATENT DOCUMENTS

2006/0031067 A1* 2/2006 Kaminuma ..... G10L 21/0208 704/226
2014/0105412 A1* 4/2014 Alves ..... G10K 11/178 381/71.6

* cited by examiner

*Primary Examiner* — Melur Ramakrishnaiah
(74) *Attorney, Agent, or Firm* — Bacon & Thomas, PLLC

(57) ABSTRACT

A sound playback device and a noise reducing method thereof are disclosed. The method comprises the steps of: receiving an input sound signal, wherein the input sound signal includes a noise; performing a first denoising processing procedure to the input sound signal to obtain a first processing sound signal; performing a noise analysis procedure to the input sound signal to generate an analysis result; performing a second denoising processing procedure to the first processing sound signal to obtain a second processing sound signal according to the analysis result so as to reduce the noise; and outputting the second processing sound signal.

10 Claims, 3 Drawing Sheets

SOUND PLAYBACK DEVICE AND NOISE REDUCING METHOD THEREOF

BACKGROUND OF THE INVENTION

1. Field of the Invention

The present invention relates to a sound playback device and a noise reducing method thereof; more particularly, the present invention relates to a sound playback device and a noise reducing method thereof capable of executing two denoising processing procedures at the same time.

2. Description of the Related Art

In order to provide a user with a better and clearer sound, a present sound playback device, such as a headphone, would usually combine several mechanisms to eliminate environmental noise. In the prior art, a denoising mechanism such as a conventional denoising algorithm or an artificial intelligence denoising process has been disclosed. A conventional denoising algorithm utilizes techniques such as spectral subtraction or Wiener filter to achieve the denoising purpose. An artificial intelligence denoising process provides mass data to make a machine self-learn induction and classification techniques therefrom, so as to achieve the object of minimizing, as much as possible, the difference between each output and target. However, the artificial intelligence denoising process requires mass data for machine learning; furthermore, in the event that prior data cannot replace scene features in practical applications, it would possibly result in tremendous errors. As a result, the artificial intelligence denoising process has weak recognition performance for certain categories of noises.

Therefore, there is a need to provide a sound playback device and a noise reducing method thereof to mitigate and/or obviate the aforementioned problems.

SUMMARY OF THE INVENTION

It is an object of the present invention to provide a sound playback device, capable of executing two denoising processing procedures at the same time to achieve a better denoising result.

It is another object of the present invention to provide a noise reducing method applied in the abovementioned sound playback device.

To achieve the abovementioned objects, the sound playback device of the present invention comprises a sound receiving module, a first processing module, a second processing module and a sound output module. The sound receiving module is used for receiving an input sound signal, wherein the input sound signal includes a noise. The first processing module is electrically connected to the sound receiving module, and is used for performing a first denoising processing procedure to the input sound signal to obtain a first processing sound signal. The second processing module is electrically connected to the sound receiving module and the first processing module, and is used for performing a noise analysis procedure to the input sound signal to generate an analysis result. The second processing module is further used for performing a second denoising processing procedure to the first processing sound signal according to the analysis result, so as to reduce the noise to obtain a second processing sound signal. The sound output module is electrically connected to the second processing module, and is used for outputting the second processing sound signal.

The noise reducing method of the present invention comprises the following steps: receiving an input sound signal, wherein the input sound signal includes a noise; performing a first denoising processing procedure to the input sound signal to obtain a first processing sound signal; performing a noise analysis procedure to the input sound signal to generate an analysis result; performing a second denoising processing procedure to the first processing sound signal according to the analysis result, so as to reduce the noise to obtain a second processing sound signal; and outputting the second processing sound signal.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
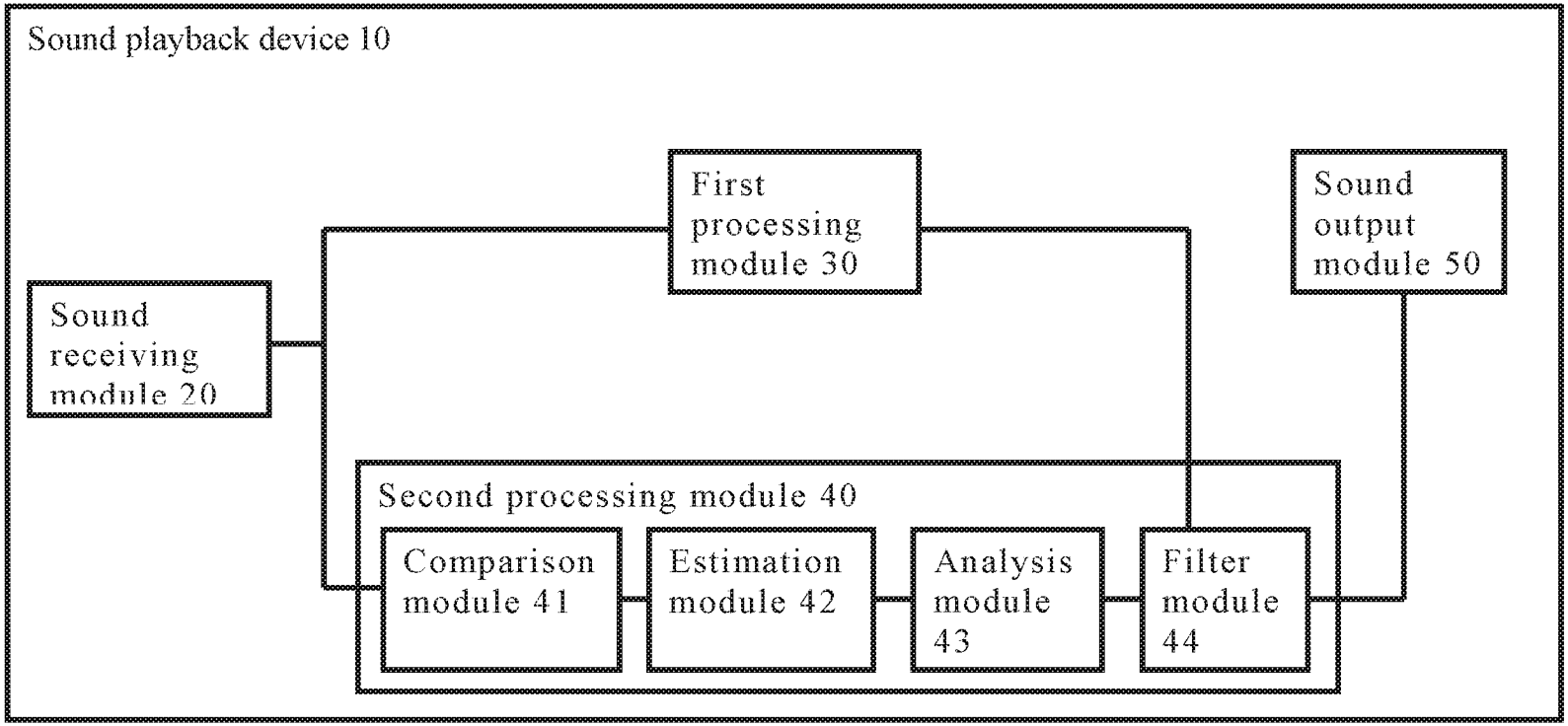
FIG. 1 illustrates a structural schematic drawing of a sound playback device according to the present invention.

Please refer to FIG. 1, which illustrates a structural schematic drawing of a sound playback device according to the present invention.

The sound playback device 10 of the present invention can be a headphone or a hearing aid without limiting the scope of the present invention. The sound playback device 10 comprises a sound receiving module 20, a first processing module 30, a second processing module 40 and a sound output module 50. The sound receiving module 20 is used for receiving an input sound signal. The input sound signal received by the sound receiving module 20 may include an audio signal transmitted from another electronic device, and/or an environmental sound captured by a microphone (not shown in figures) from the outside of the sound playback device 10. Therefore, the input sound signal includes a noise. The first processing module 30 is electrically connected to the sound receiving module 20, and is used for performing a first denoising processing procedure to the input sound signal to obtain a first processing sound signal, wherein the first processing module 30 performs an artificial intelligence denoising processing procedure. The first processing module 30 can self-learn induction and classification from mass data, and can self-adjust internal parameters to perform processing to the input sound signal. Because the artificial intelligence denoising processing procedure is well known to those skilled in related arts, there is no need for further description with regard to its principles and how it works.

The second processing module 40 is electrically connected to the sound receiving module 20 and the first processing module 30, and is used for performing a noise analysis procedure to the input sound signal to generate an analysis result. The noise analysis procedure is a non-artificial intelligence analysis procedure. For example, the noise analysis procedure can obtain a predicted noise according to estimation based on a spectral gain function. The spectral gain function is a result calculated from either a priori signal-to-noise ratio (priori SNR) or a posteriori signal-to-noise ratio (posteriori SNR). The second processing module 40 is further used for performing a second denoising processing procedure to the first processing sound signal according to the analysis result, so as to reduce the noise to obtain a second processing sound signal. For example, methods, without limiting the scope of the present invention, such as spectral subtraction (SS) or Wiener Filter can be used for such processing. Finally, the sound output module 50, which can be a speaker or an equivalent device, is electrically connected to the second processing module 40 for outputting the second processing sound signal.

In one embodiment of the present invention, the second processing module 40 utilizes an algorithm to perform the noise analysis procedure, such as a noise estimation analysis procedure. The noise estimation analysis procedure can be analysis methods such as, but is not limited to, Speech Presence Probability (SPP), Improved Minima Controlled Recursive Averaging (IMCRA), and/or Minima-Tracking. The second processing module 40 comprises a comparison module 41, an estimation module 42, an analysis module 43 and a filter module 44. The comparison module 41 is used for comparing the strength of the input sound signal with a previous frame estimated noise strength to obtain a signal-to-noise ratio (SNR). The estimation module 42 is used for calculating an estimated noise strength according to the signal-to-noise ratio. The analysis module 43 is used for analyzing the strength of the input sound signal and the estimated noise strength to generate the analysis result, wherein the analysis result is a mask value. As a result, the analysis module 43 can be aware of the proportion of the noise in the input sound signal, and the non-noise part can be obtained by excluding the masking part. Finally, the filter module 44 is used for reducing partial strength of the first processing sound signal by the mask value generated by the analysis module 43, so as to eliminate the noise accordingly. Therefore, the sound output module 50 can output the processed second processing sound signal. Because each of the above noise estimation analysis procedures has been widely applied in related technical fields by those skilled in the art, there is no need for further description.

Please note that each of the abovementioned modules can be accomplished by a hardware device, a software program, a firmware or a combination thereof, it can also be configured in the form of a circuit loop or other suitable format. Further, each of the modules can be configured either in an independent form, or in a combined form. Moreover, the embodiment disclosed herein only describes a preferred embodiment of the present invention. To avoid redundant description, not all possible variations and combinations are described in detail in this specification. However, those skilled in the art would understand the above modules or components are not all necessary parts. And, in order to implement the present invention, other more detailed known modules or components might also be included. It is possible that each module or component can be omitted or modified depending on different requirements; and it is also possible that other modules or components might be disposed between any two modules.

Figure 2:
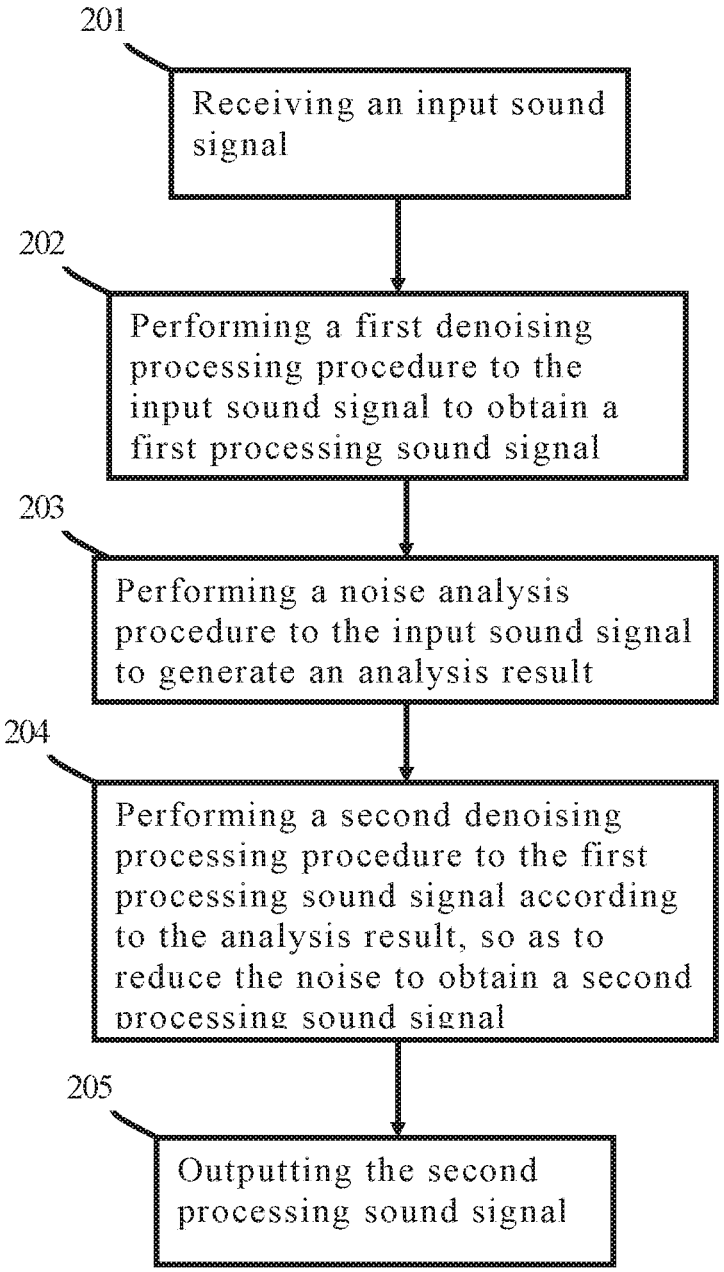
FIG. 2 illustrates a flowchart of a noise reducing method according to the present invention.

Next, please refer to FIG. 2, which illustrates a flowchart of a noise reducing method according to the present invention. Please note that although the abovementioned sound playback device 10 is used as an example to explain the noise reducing method of the present invention, the noise reducing method of the present invention is not limited to be implemented only to the sound playback device 10 have the same structure as stated above.

First, the method performs step 201: receiving an input sound signal.

At first, the sound receiving module 20 is used for receiving an input sound signal.

Then, the method performs step 202: performing a first denoising processing procedure to the input sound signal to obtain a first processing sound signal.

Then, the first processing module 30 is used for performing a denoising processing procedure to the input sound signal, so as to utilize an artificial intelligence denoising processing procedure to convert the input sound signal into a first processing sound signal.

Next, the method performs step 203: performing a noise analysis procedure to the input sound signal to generate an analysis result.

Next, the second processing module 40 is used for performing a noise estimation analysis procedure to the most original input sound signal, so as to generate an analysis result, in order to know the proportion of the noise in the original input sound signal.

Further, the method performs step 204: performing a second denoising processing procedure to the first processing sound signal according to the analysis result, so as to reduce the noise to obtain a second processing sound signal.

The second processing module 40 further performs a second denoising processing procedure to the first processing sound signal being processed by the first processing module 30, so as to reduce the noise in the first processing sound signal to obtain a second processing sound signal.

Finally, the method performs step 205: outputting the second processing sound signal.

Finally, the sound output module 50 can output the second processing sound signal being processed by the second processing module 40.

Figure 3:
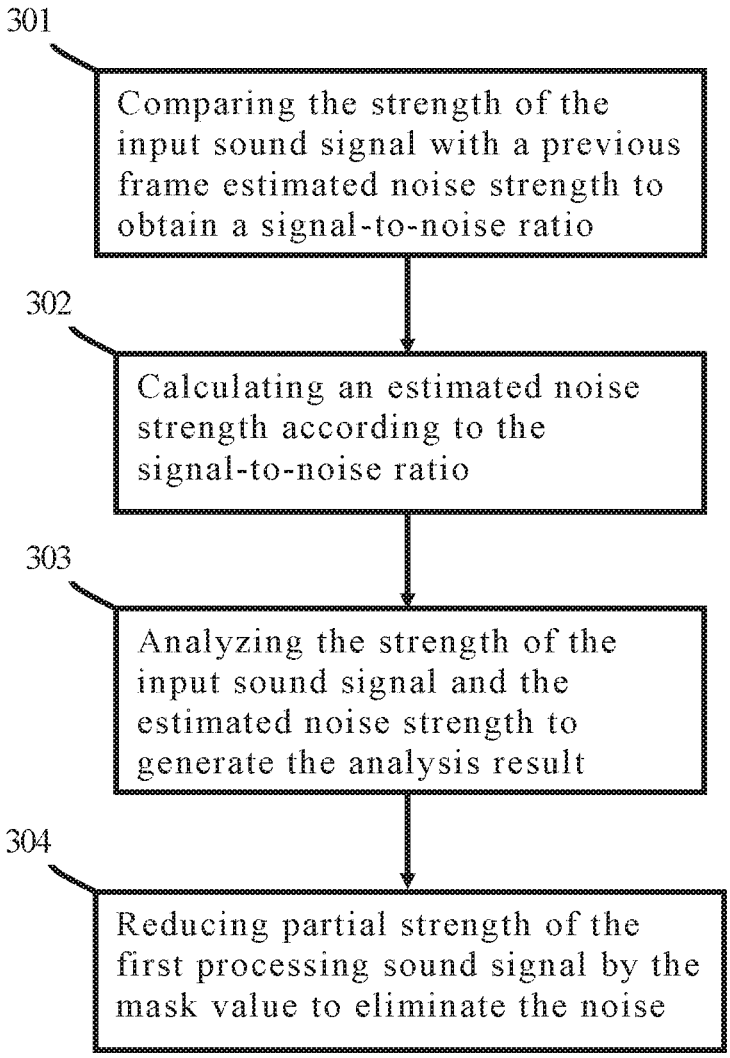
FIG. 3 illustrates a flowchart including steps of a noise analysis procedure according to the present invention.

Next, please refer to FIG. 3, which illustrates a flowchart including steps of the noise analysis procedure according to the present invention.

In one embodiment of the present invention, the second processing module 40 utilizes an algorithm to perform the noise reducing procedure in step 203 and step 204. Therefore, step 301 is performed first: comparing the strength of the input sound signal with a previous frame estimated noise strength to obtain a signal-to-noise ratio.

First, the comparison module 41 compares the strength of the input sound signal with a previous frame estimated noise strength to obtain a signal-to-noise ratio.

Then, step 302 is performed: calculating an estimated noise strength according to the signal-to-noise ratio.

Then, the estimation module 42 can calculate an estimated noise strength according to the signal-to-noise ratio based on an equation. The equation is, but not limited to, Speech Presence Probability (SPP), Improved Minima Controlled Recursive Averaging (IMCRA), and/or Minima-Tracking.

Next, step 303 is performed: analyzing the strength of the input sound signal and the estimated noise strength to generate the analysis result.

Next, the analysis module 43 analyzes the strength of the input sound signal and the estimated noise strength to generate the analysis result, which is a mask value.

Finally, step 304 is performed: reducing partial strength of the first processing sound signal by the mask value to eliminate the noise.

Finally, the filter module 44 reduce partial strength of the first processing sound signal by the mask value generated by the analysis module 43 to eliminate the noise, thereby obtaining the second processing sound signal.

Please note that the noise reducing method of the present invention is not limited to be executed in the above step orders. The execution order of the abovementioned steps can be altered as long as the object of the present invention can be achieved.

According to the above description, the sound playback device 10 of the present invention firstly utilizes the first processing module 30 to perform the artificial intelligence denoising processing procedure to the input sound signal, so as to obtain the first processing sound signal. The second processing module 40 then utilizes the conventional algorithm to analyze the input sound signal, and finally utilizes the analysis result to process the first processing sound signal in order to obtain the second processing sound signal. Therefore, the sound playback device 10 of the present invention can perform an artificial intelligence denoising processing procedure and a conventional algorithm denoising processing procedure at the same time, thereby achieving better noise reduction performance.

Although the present invention has been explained in relation to its preferred embodiments, it is to be understood that many other possible modifications and variations can be made without departing from the spirit and scope of the invention as hereinafter claimed.

What is claimed is:

1. A noise reducing method, comprising the steps of:

receiving an input sound signal, wherein the input sound signal includes a noise;

performing a first denoising processing procedure to the input sound signal to obtain a first processing sound signal;

performing a noise analysis procedure to the input sound signal to generate an analysis result, wherein the analysis result is a mask value;

performing a second denoising processing procedure to the first processing sound signal according to the analysis result, so as to reduce the noise to obtain a second processing sound signal; and outputting the second processing sound signal.

2. The noise reducing method as claimed in claim 1, wherein the first denoising processing procedure is an artificial intelligence denoising processing procedure for self-learning induction and classification from a mass data, and self-adjusting internal parameters to perform processing to the input sound signal.

3. The noise reducing method as claimed in claim 2, wherein the step of performing the noise analysis procedure is to perform a non-artificial intelligence analysis procedure, wherein the non-artificial intelligence analysis procedure is a noise estimation analysis procedure.

4. The noise reducing method as claimed in claim 3, wherein the noise analysis procedure for analyzing a speech presence probability comprises the following steps:

comparing the strength of the input sound signal with a previous frame estimated noise strength to obtain a signal-to-noise ratio;

calculating an estimated noise strength according to the signal-to-noise ratio; and analyzing the strength of the input sound signal and the estimated noise strength to generate the analysis result.

5. The noise reducing method as claimed in claim 3, wherein the second denoising processing procedure is used for reducing partial strength of the first processing sound signal by the mask value to eliminate the noise.

6. A sound playback device, comprising:

a sound receiving module, used for receiving an input sound signal, wherein the input sound signal includes a noise;

a first processing module, electrically connected to the sound receiving module, used for performing a first denoising processing procedure to the input sound signal to obtain a first processing sound signal;

a second processing module, electrically connected to the sound receiving module and the first processing module, used for performing a noise analysis procedure to the input sound signal to generate an analysis result, wherein the analysis result is a mask value, wherein the second processing module is further used for performing a second denoising processing procedure to the first processing sound signal according to the analysis result, so as to reduce the noise to obtain a second processing sound signal; and a sound output module, electrically connected to the second processing module, used for outputting the second processing sound signal.

7. The sound playback device as claimed in claim 6, wherein the first processing module is used for performing an artificial intelligence denoising processing procedure for self-learning induction and classification from a mass data, and self-adjusting internal parameters to perform processing to the input sound signal.

8. The sound playback device as claimed in claim 7, wherein the second processing module is used for performing a non-artificial intelligence analysis procedure, wherein the non-artificial intelligence analysis procedure is a noise estimation analysis procedure.

9. The sound playback device as claimed in claim 8, wherein the second processing module further comprises:

a comparison module, used for comparing the strength of the input sound signal with a previous frame estimated noise strength to obtain a signal-to-noise ratio;

an estimation module, used for calculating an estimated noise strength according to the signal-to-noise ratio; and an analysis module, used for analyzing the strength of the input sound signal and the estimated noise strength to generate the analysis result.

10. The sound playback device as claimed in claim 8, wherein the second processing module further comprising a filter module used for reducing partial strength of the first processing sound signal by the mask value to eliminate the noise.

* * * * *